US006357531B1

(12) United States Patent
Asselin

(10) Patent No.: US 6,357,531 B1
(45) Date of Patent: Mar. 19, 2002

(54) VIRTUAL ACCELERATOR FOR DETECTING AN ALARM CONDITION WITHIN A PRESSURIZED GAS SPRINKLER SYSTEM AND METHOD THEREOF

(75) Inventor: Jean-Pierre Asselin, Blainville (CA)

(73) Assignee: Systems Fireflex Inc., Quebec (CA)

( * ) Notice: Subject to any disclaimer, the term of this patent is extended or adjusted under 35 U.S.C. 154(b) by 57 days.

(21) Appl. No.: 09/631,775

(22) Filed: Aug. 3, 2000

(30) Foreign Application Priority Data

May 30, 2000 (CA) ..... 2310303

(51) Int. Cl.[7] ..... A62C 35/00

(52) U.S. Cl. ..... 169/17; 169/20; 169/43; 169/60

(58) Field of Search ..... 169/20, 17, 26, 169/61, 60, 43, 46

(56) References Cited

U.S. PATENT DOCUMENTS

| | | | | |
|---|---|---|---|---|
| 3,762,477 A | | 10/1973 | Mobley, Sr. | |
| 3,834,463 A | | 9/1974 | Allard et al. | |
| 3,888,314 A | | 6/1975 | Landsberg | |
| 3,949,812 A | | 4/1976 | Hay | |
| 3,958,643 A | * | 5/1976 | Landsberg | 169/20 |
| 4,305,469 A | | 12/1981 | Morrisette | |
| 4,356,868 A | | 11/1982 | Bentley et al. | |
| 4,401,976 A | | 8/1983 | Stadelmayr | |
| 4,570,719 A | | 2/1986 | Wilk | |
| 5,027,905 A | | 7/1991 | Cousineau et al. | |
| 5,099,925 A | * | 3/1992 | Glidden et al. | 169/17 |
| 5,236,049 A | * | 8/1993 | Asselin et al. | 169/20 |
| 5,320,138 A | * | 6/1994 | Ferlitch, Jr. | 169/61 |
| 5,653,291 A | | 8/1997 | Sundholm | |
| 5,680,329 A | | 10/1997 | Lloyd et al. | |
| 5,720,351 A | * | 2/1998 | Beukema et al. | 169/17 |
| 5,808,541 A | | 9/1998 | Golden | |
| 5,915,480 A | | 6/1999 | Yemelyanov et al. | |
| 5,918,680 A | | 7/1999 | Maranghides | |
| 5,927,406 A | | 7/1999 | Kadoche | |
| 5,950,150 A | | 9/1999 | Lloyd et al. | |
| 5,971,080 A | * | 10/1999 | Loh et al. | 169/17 |

* cited by examiner

*Primary Examiner*—David A. Scherbel
*Assistant Examiner*—Dinh Q. Nguyen
(74) *Attorney, Agent, or Firm*—Sughrue Mion, PLLC

(57) ABSTRACT

The virtual accelerator is for detecting an alarm condition within a pressurized gas sprinkler system. It has a pressure monitor for monitoring pressure within the pressurized gas sprinkler system, and generating a pressure signal representative of the pressure thereof; a sampler for sampling the pressure signal at a given frequency during a predetermined period of time, and generating a series of pressure values; and a detector for detecting variations of the pressure values, and generating an alarm signal if the variations are within a predetermined range. A method for detecting an alarm condition within a pressurized gas sprinkler system is also proposed.

14 Claims, 10 Drawing Sheets

VIRTUAL ACCELERATOR FOR DETECTING AN ALARM CONDITION WITHIN A PRESSURIZED GAS SPRINKLER SYSTEM AND METHOD THEREOF

FIELD OF THE INVENTION

The present invention relates to a virtual accelerator for detecting an alarm condition within a pressurized gas sprinkler system, and a method thereof.

BACKGROUND OF THE INVENTION

Known in the prior art is the dry pipe accelerator which is a hardware device that monitors a sprinkler system and activates the sprinkler system when a predetermined condition is met. For example, the condition is met when a significant rate of decay in system gas pressure occurs. The setting of the accelerator is factory set and cannot be changed by an operator. Furthermore, it is very difficult to coordinate the setting of the accelerator with the whole operation of the system.

Also known in the art is U.S. Pat. No. 5,236,049 in which is described an electronic fire reporting and sprinkling control module for connection to a control bus of a file alarm system. The control module is connected to a series of detectors. One of these detectors includes an air pressure switch which detects an air pressure drop in the sprinkler system. The switch provides an on or off signal corresponding to a such drop in pressure.

A disadvantage with the previous system is that the pressure switch has little flexibility because it is only restricted to two possible states of the sprinkler system, high pressure and low pressure.

Also known in the art is U.S. Pat. No. 5,971,080 in which is described a system for monitoring a rate of loss of pressure (dp/dt) in a dry pipe sprinkler. A comparison between the monitored rate of loss of pressure and a predetermined value is used to detect whether there is an open sprinkler head. Although the patent claims that the system is capable of accurately discriminating between false alarms, it is still susceptible to false alarms under normal operating conditions because no filtering of the monitored values is performed. Another drawback is that after the air compressor is turned off, the system is given a certain time to stabilize. During this time, the system cannot monitor the rate of loss of pressure and therefore cannot determine whether there is an open sprinkler head. Furthermore, the inherent presence of water in the dry pipe sprinkler and sudden changes in temperature foster changes in pressure that may lead to false alarms, especially after the compressor is turned off. Therefore, the system is ill equipped to deal with transient pressure changes that may occur during normal operating conditions of the dry pipe sprinkler and compressor.

Also known in the art, there are the following U.S. patents describing different sprinkler systems using a pressure detector having a predetermined threshold: U.S. Pat. Nos. 3,762,477; 3,888,314; 3,958,643; 4,356,868; 5,027,905; and 5,808,541. U.S. Pat. No. 4,570,719 describes a mechanical dry pipe accelerator.

Also known in the art, there are the following U.S. patents describing different fire extinguishing systems: U.S. Pat. Nos. 3,834,463; 3,949,812; 4,305,469; 4,356,868; 5,236,049; 5,653,291; 5,680,329; 5,915,480; 5,918,680; 5,927,406; 5,950,150. U.S. Pat. No. 4,401,976 describes an alarm system.

An object of the present invention is to provide a more sensitive accelerator than the above-mentioned previously known accelerators that distinguishes more efficiently between false alarms and real alarms.

SUMMARY OF THE INVENTION

According to the present invention, there is provided a virtual accelerator for detecting an alarm condition within a pressurized gas sprinkler system, comprising:

- a pressure monitoring means for monitoring pressure within the pressurized gas sprinkler system, and generating a pressure signal representative of the pressure thereof;
- sampling means for sampling the pressure signal at a given frequency during a predetermined period of time, and generating a series of pressure values; and
- detecting means for detecting variations of the pressure values, and generating an alarm signal if the variations are within a predetermined range, the detecting means further comprising a low pass filter for low pass filtering the variations of the pressure values, and generating a first positive signal if the variations are within a low pass filter range.

Also, according to the present invention, there is provided a method for detecting an alarm condition within a pressurized gas sprinkler system, comprising the steps of:

(a) monitoring pressure within the pressurized gas sprinkler system, and generating a pressure signal representative of the pressure thereof;

(b) sampling the pressure signal at a given frequency during a predetermined period of time, and providing a series of pressure values; and (c) detecting variations of the pressure values, and generating an alarm signal if the variations are within a predetermined range, the step of detecting variations further comprising the step of low pass filtering the variations of the pressure values, and generating a first positive signal if the variations are within a low pass filter range.

BRIEF DESCRIPTION OF THE DRAWINGS

The invention as well as its numerous advantages will be better understood by the following non-restrictive description of possible embodiments made in reference to the appended drawings in which.

DETAILED DESCRIPTION OF THE INVENTION

Figure 1:
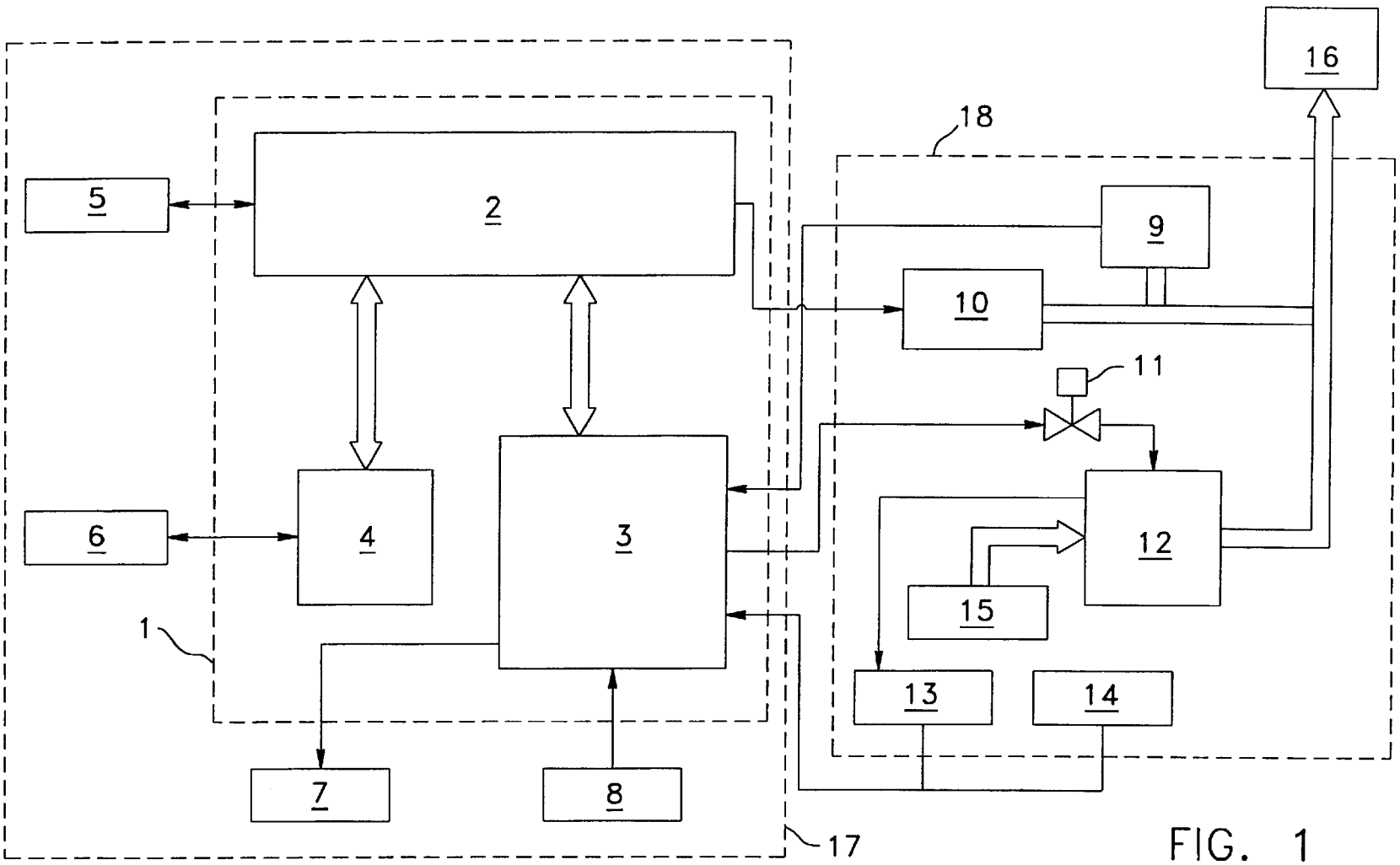
FIG. 1 shows a block diagram illustrating a pressurized gas sprinkler system incorporating a virtual accelerator according to the present invention.

Referring now to FIG. 1, there is shown a virtual accelerator for detecting an alarm condition within a pressurized gas sprinkler system 16. The virtual accelerator comprises a pressure monitoring device, which is preferably embodied by a pressure transducer 9, for monitoring pressure within the pressurized gas sprinkler system 16 and generating a pressure signal representative of the pressure thereof.

The virtual accelerator further comprises a sampling device, which is preferably embodied by a base controller 3 provided with a software, for sampling the pressure signal at a given frequency during a predetermined period of time, and generating a series of pressure values. Of course, those skilled in the art will understand that the sampling device may be embodied in a different manner and located elsewhere, such as on the pressure transducer 9 for example. Furthermore, the virtual accelerator also comprises a detecting device, which is preferably embodied by the base controller 3 provided with a software, for detecting variations of the pressure values, and generating an alarm signal if the variations are within a predetermined range.

Preferably, this detecting device comprises a low pass filter for low pass filtering the variations of the pressure values, and generating a first positive signal if the variations are within a low pass filter range. The detecting device also comprises a first calculating software module for calculating pressure change rates of the pressure signal within the predetermined period of time by means of the pressure values. The detecting device also comprises a second calculating software module for calculating a mean value of the pressure change rates. The detecting device also comprises a first comparing software module for comparing the mean value with a target value, and generating a second positive signal if the mean value exceeds the target value. Lastly, the detecting device also comprises an alarm signal generating software module for generating the alarm signal in response to an occurrence of the first and second positive signals simultaneously during the predetermined period of time.

Preferably, the virtual accelerator further comprises a console 4 and a master controller 2 connected to the base controller 3, for controlling communications with an external network 5 and with the console 4.

Preferably, in the virtual accelerator, the console 4 comprises a display unit, an electronic buzzer, and interface key switches to allow communication between an operator 6 and the base controller 3 via the master controller 2. The display unit may be an LCD or LED screen for observing the status of the sprinkler system 16.

Referring back to FIG. 1, the block diagram incorporating the virtual accelerator is divided into an electrical section 17 and a mechanical section 18. The electrical section 17 has a fire protection controller 1 which comprises the master controller 2, the base controller 3 and the console 4. The external network 5 is connected to the master controller 2. Furthermore, the base controller 3 is connected to output devices 7 and input devices 8.

The master controller 2 is connected to the external network 5 for transmitting or receiving information from external systems, PC computers, or remote annunciators. The information transmitted relates to the system pressure, system status, or any information regarding the fire or system condition. The information received relates to control commands or fire condition inputs.

The output devices 7 may be signaling devices, solenoid valves or any equipment related to the fire protection system. The input devices 8 may be fire alarm detectors, a manual pull station, an abort station, supervisory devices or any device for providing input information regarding fire or system conditions.

The mechanical section 18 comprises a water control valve 12 having an input connected to a water supply 15 and an output connected to the sprinkler system 16. Solenoid valves 11 control the automatic operation of the water control valve 12. The solenoid valves 11 are controlled by the fire protection controller 1 via the base controller 3 to which the valves 11 are connected. A water pressure switch 13, which has an output connected to the base controller 3, detects the operation of the water control valve 12. Valve supervisory switches 14, which also have outputs connected to the base controller 3, detect abnormal valve position of valves (not shown) located upstream and downstream of the water control valves 12. A pressurized gas supply device 10 is used to pressurize the sprinkler system 16. The pressurized gas supply device 10 may be an air compressor or any positive or negative pressure system. The pressurized gas supply device 10 is controlled by and connected to the master controller 2. The pressure transducer 9 has an input connected to the sprinkler system 16 and an output connected to the base controller 3. The pressure transducer 9, which is preferably an analog pressure transducer, transmits a continuous analog pressure signal to the base controller 3. The continuous analog pressure signal is representative of the pressure within the sprinkler system 16.

Briefly, during the operation of the virtual accelerator, pressurized gas is provided in the piping of the sprinkler system 16 by means of the pressurized gas supply device 10. The pressurized gas of the sprinklers system 16 is monitored by the analog pressure transducer 9. This information is provided to the base controller 3 which processes this information and upon detection of certain conditions, said base controller 3 activates the solenoid valves 11 of the water control valve 12 so that water is allowed to flow from the water supply 15 through the sprinkler system 16.

During its operation, the virtual accelerator can be set and adjusted at any time through the electrical section 17 via the master controller 2 and the external network 5, or via the master controller 2 and the console 4.

Figure 2A:
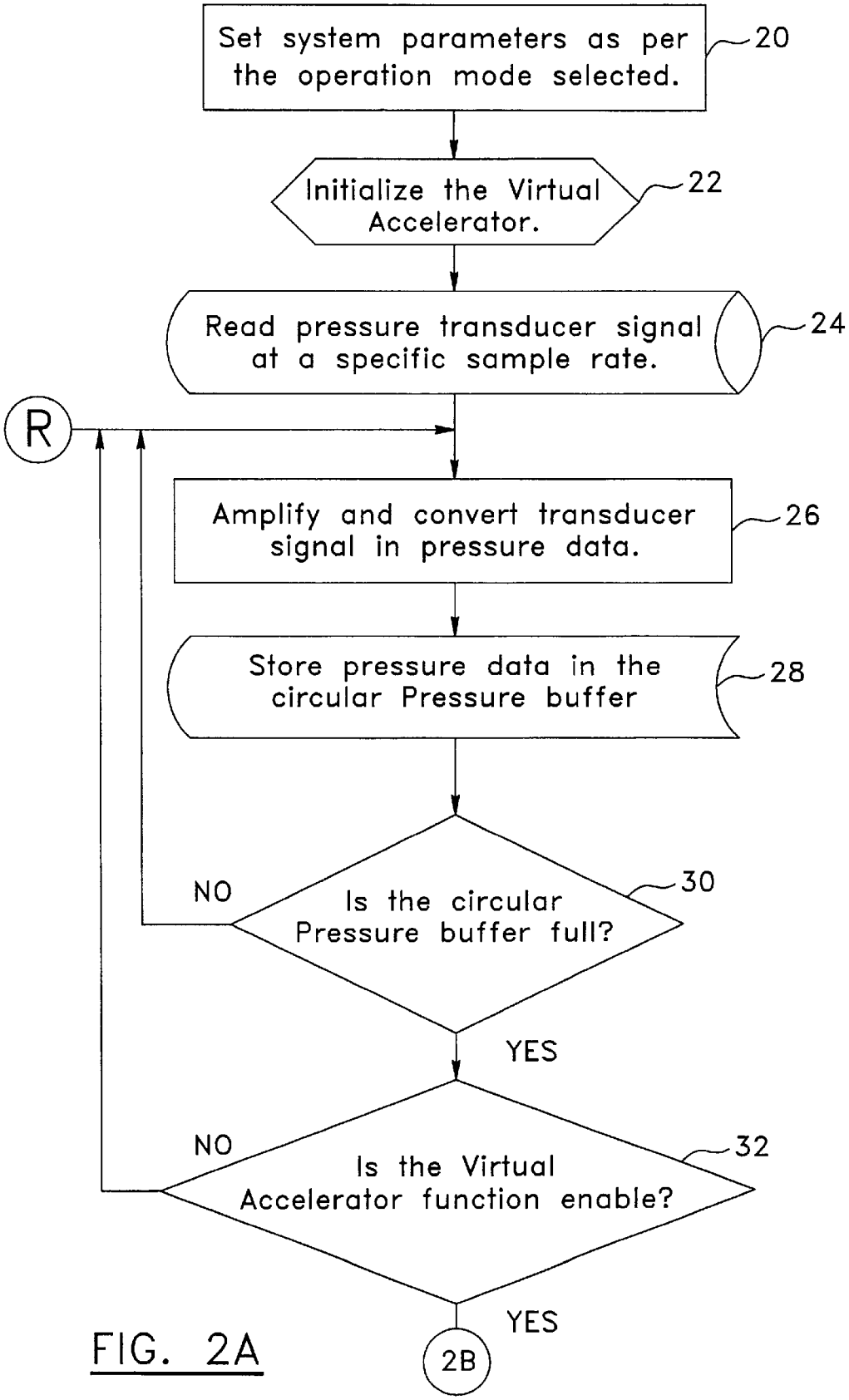
FIGS. 2 to 6 show a flow diagram illustrating an operation of the virtual accelerator shown in FIG. 1.
Figure 2B:
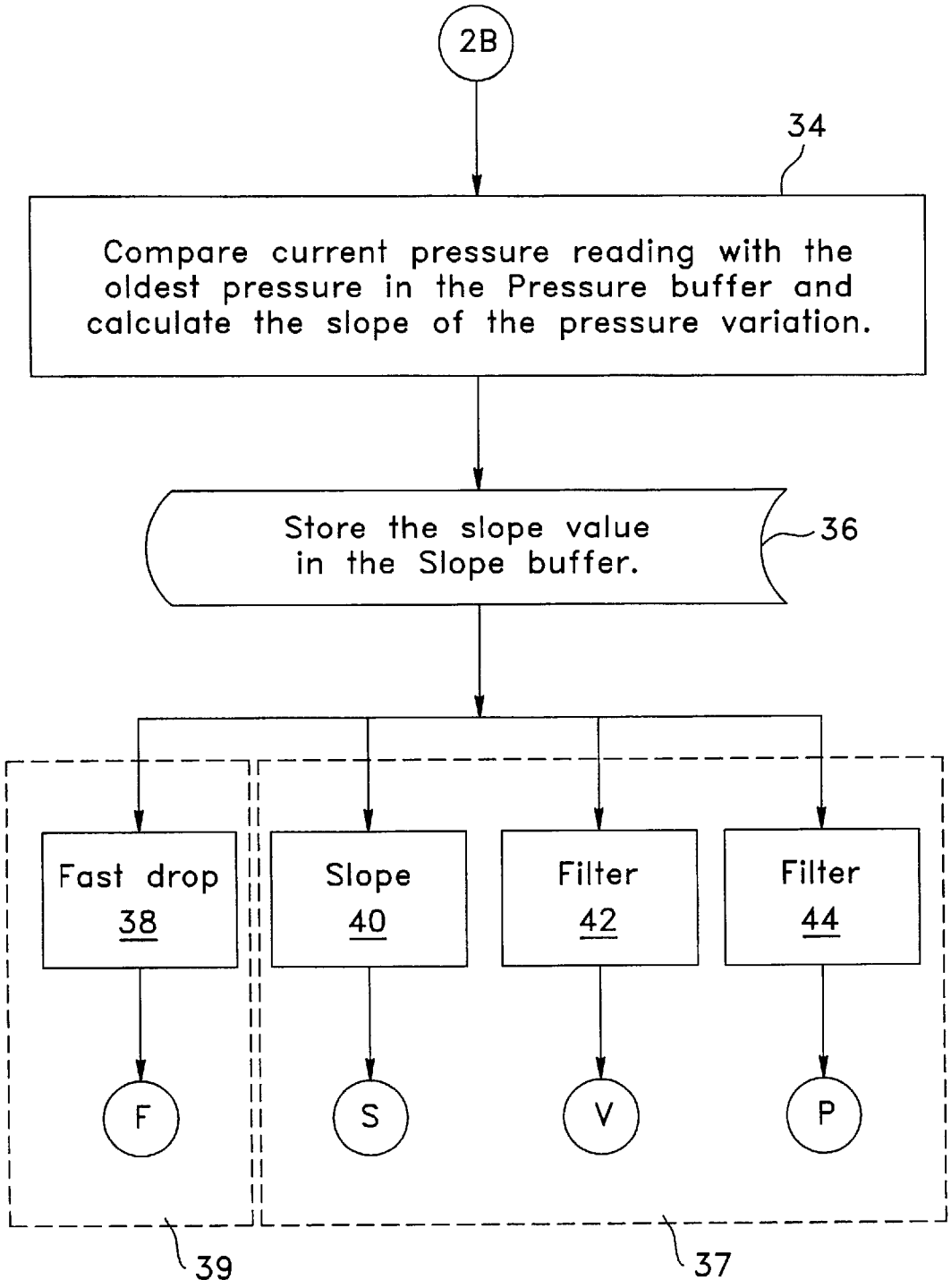

Referring now to FIGS. 2 to 6, there is shown a preferred embodiment of an operation of the virtual accelerator according to the present invention. Essentially, the method for detecting the alarm condition within a pressurized gas sprinkler system 16, comprises the steps of:

(a) monitoring pressure within the pressurized gas sprinkler system, and generating a pressure signal representative of the pressure thereof;

(b) sampling the pressure signal at a given frequency during a predetermined period of time, and providing a series of pressure values, steps (a) and (b) being preferably performed by operation steps 24, 26 and 28 shown in FIG. 2A; and (c) detecting variations of the pressure values, and generating an alarm signal if the variations are within a predetermined range, step (c) being preferably performed by operation steps 34, 36, 38, 40, 42 and 44 shown in FIG. 2B.

Referring now to FIGS. 2A, 2B, 3 and 6, preferably, step (c) comprises the steps of:

(i) low pass filtering the variations of the pressure values, and generating a first positive signal (RES EMPTY and PRES DIFF) if the variations are within a low ass filter range according to operation steps 42 and 44;

(ii) calculating pressure change rates of the pressure signal within the predetermined period of time by means of the pressure values according to operation step 34;

(iii) calculating a mean value of the pressure change rates according to operation step 46;

(iv) comparing the mean value with a target value, and generating a second positive signal MIN SLOPE if the mean value exceeds the target value, according to operation steps 48 and 50; and (v) generating the alarm signal when said first and second positive signals MIN SLOPE, RES EMPTY and PRES DIFF are occurring simultaneously during the predetermined period of time, according to operation steps 80 and 82.

Preferably, step (b) of the above method comprises the steps of:

storing each value of the series of pressure values in a circular pressure buffer according to a chronological order, as shown in operation step 28; and when the circular pressure buffer is full, removing an oldest pressure value from the buffer, and storing a newest pressure value in the buffer according to a chronological order, as shown in operation steps 24, 26, 28 and 30 which form a loop.

Preferably, in step (c) (ii), the pressure change rates are calculated by calculating a series of pressure slope values from subsequent pairs of newest and oldest pressure values stored in the pressure buffer, and storing the series of pressure slope values in a slope buffer according to a chronological order, as shown in steps 34 and 36. Preferably, in step (c) (iii), the mean value is calculated by calculating a mean value of the series of pressure slope values in the slope buffer, as shown in step 46. Preferably, in step (c) (i), the low pass filtering step comprises the steps (A), (B) and (C) illustrated respectively in FIGS. 4, 5A, 5B and 6.

Figure 4:
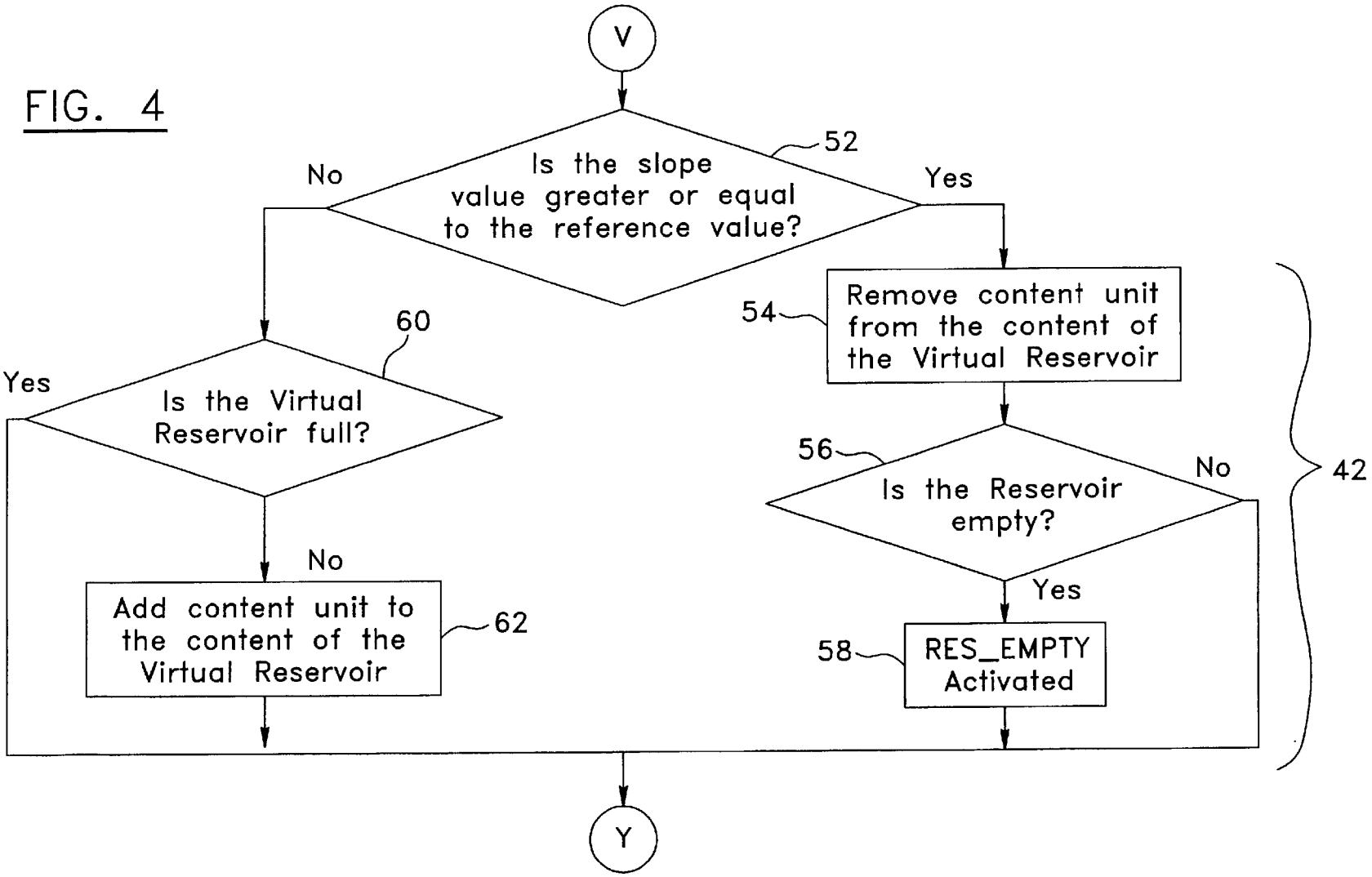

Referring now to FIG. 4, step (A) comprises steps of:

comparing a newest pressure slope value in the slope buffer with a reference slope value as shown in operation step 52, and:

if the newest pressure slope value is equal or exceeds the reference slope value then:

subtracting a content unit from a virtual reservoir as shown in operation 54; and verifying whether the virtual reservoir is empty and if said virtual reservoir is empty then generating an empty reservoir signal RES EMPTY as shown in operation steps 56 and 58;

or else verifying whether the virtual reservoir is not full and if said virtual reservoir is not full then adding a content unit to the virtual reservoir, as shown in operation steps 60 and 62.

Figure 5A:
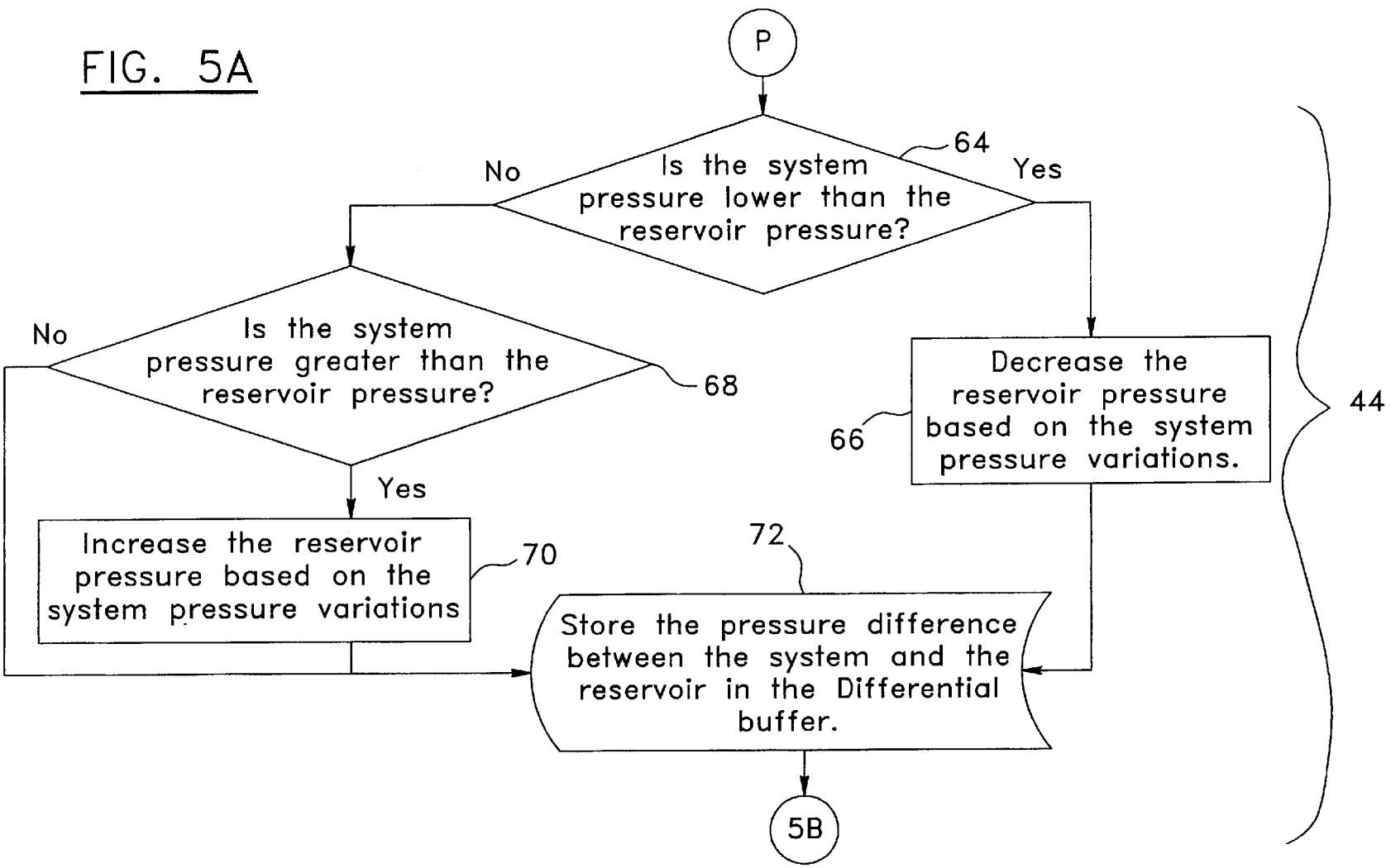
Figure 5B:
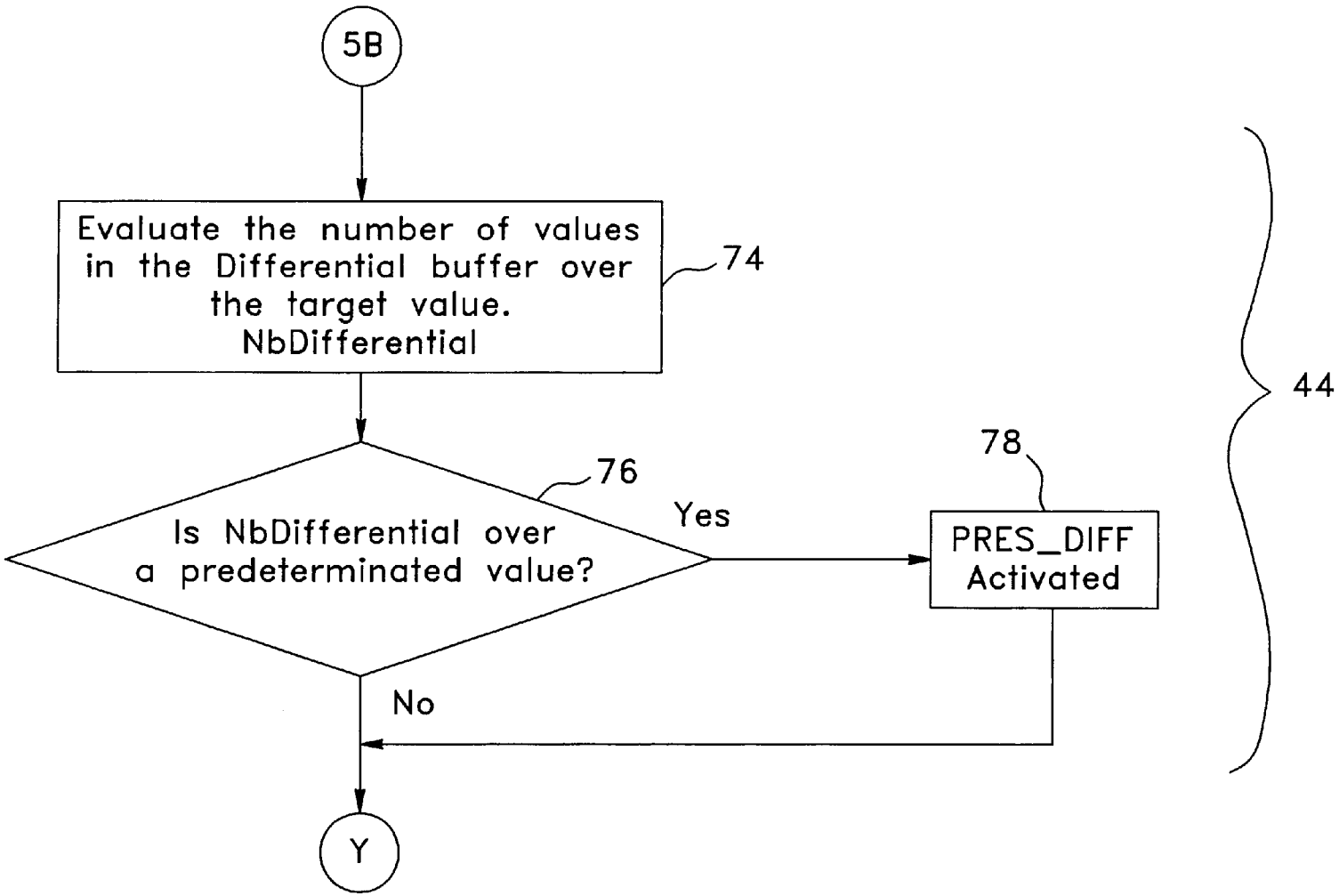

Referring now to FIGS. 5A and 5B, step (B) comprises steps of:

comparing the newest pressure value in the pressure buffer with a virtual reservoir pressure value as shown in operation step 64, and:

if the newest pressure value is below the virtual reservoir pressure value then decreasing the virtual reservoir pressure value as shown in operation step 66;

or else comparing the newest pressure value in the pressure buffer with the virtual reservoir pressure value as shown in operation step 68, and if said newest pressure value exceeds the virtual reservoir pressure value then increasing the virtual reservoir pressure value as shown in operation step 70;

storing a pressure difference between the newest pressure value and the virtual reservoir pressure value in a differential buffer as shown in operation 72;

comparing each pressure difference stored in the differential buffer with a pressure difference target value, and counting a number of these pressure differences that are over said pressure difference target value as shown in operation step 74; and comparing the number of pressure differences that are over the pressure difference target value with a predetermined value, and generating a pressure difference signal PRES DIFF if the number exceeds the predetermined value as shown in operation steps 76 and 78.

Figure 6:
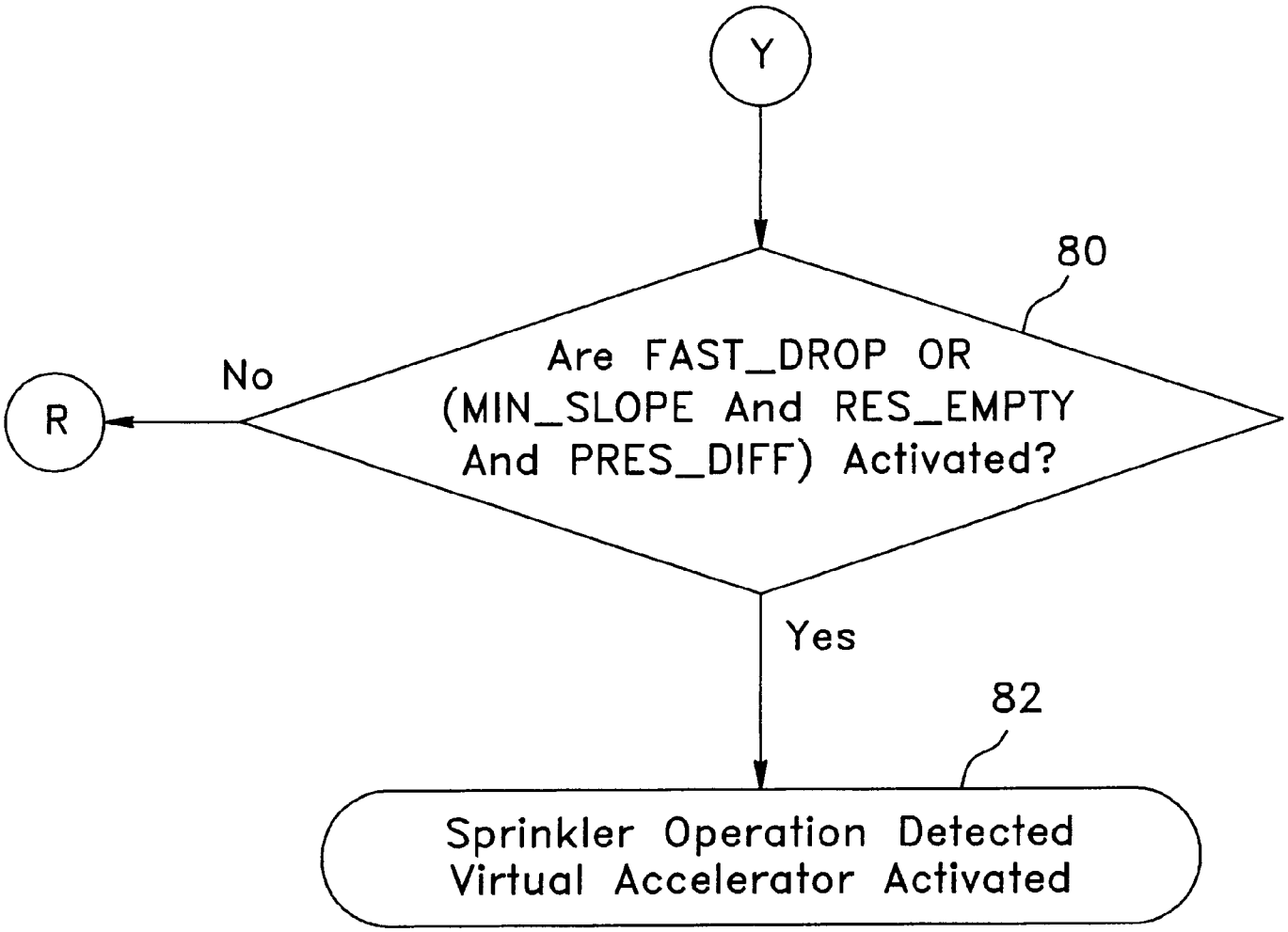

Referring now to FIG. 6, step (C) comprises the steps of verifying whether the empty reservoir and pressure difference signals RES EMPTY and PRES DIFF are occurring simultaneously during the predetermined period of time and if said empty reservoir and pressure difference signals are occurring simultaneously during the predetermined period of time then generating the first positive signal, or else return to step (a) as illustrated in operation step 80. In step 80, other conditions are verified such as whether MIN SLOPE and FAST DROP are also occurring.

Referring again to FIG. 3, preferably, step (c) of the above method further comprises the steps of:

comparing the newest pressure value in the pressure buffer with a minimum pressure reference value as shown in operation step 84, and if the newest pressure value exceeds the minimum preference reference value then:

comparing each pressure slope value stored in the slope buffer with a slope target value, and counting a number of these pressure slope values that are over said slope target value as shown in operation step 86; and comparing the number of pressure slope values that are over the slope target value with a specific value as shown in operation step 88, and generating the alarm signal FAST DROP if the number exceeds a specific value as shown in operation step 90, or else return to step (a);

or else return to step (a).

Referring now to FIGS. 1, 2A and 2B, the system or base controller 3 of the virtual accelerator is set and initialized by means of operation steps 20 and 22. A virtual accelerator in the base controller 3 is initialized with the current value read by the pressure transducer 9 at that moment. The output signal of the pressure transducer 9 is read, amplified, converted and stored in a circular pressure buffer at a specific sampling rate or frequency during a predetermined period of time as described in operation steps 24, 26 and 28. Thereby, the monitoring of pressure within the pressurized gas sprinkler system 16 is effected and a pressure signal (the output signal of the pressure transducer 9) representative of the pressure thereof is generated and the series of pressure values is provided. The base controller 3 then determines whether the pressure buffer is full and whether the accelerator function has been enabled by means of steps 30 and 32. In the present embodiment, the circular buffer and the other buffers referred to in the present description are virtual buffers in that they are embodied by the software of the base controller 3.

Preferably, as stated above, when the circular pressure buffer is full, the oldest pressure value is removed from the buffer and a newest pressure value is stored in the buffer according to a chronological order.

Then, the current pressure value is compared with the oldest pressure value contained in the pressured buffer and the slope (pressure change rate) thereof is calculated. For each current pressure value, a new slope (pressure change rate) is calculated from subsequent pairs of newest and oldest pressure values stored in the pressure buffer. All of these slopes are stored as a series of pressure slope values in a slope buffer according to a chronological order. These steps are described in operation steps 32 and 36.

At this point in the process, the system has enough information to verify whether certain conditions are met to activate the water control valve 12. In the present invention, the subroutines 40, 42 and 44 are the preferred embodiment to determine whether or not the first condition 37 is met. Subroutines 40, 42, and 44 detect variations of the pressure values and thereby generate an alarm signal if the variations are within a predetermined range. Subroutine 38 is another preferred embodiment to determine whether or not the second condition 39 is met.

Figure 3:
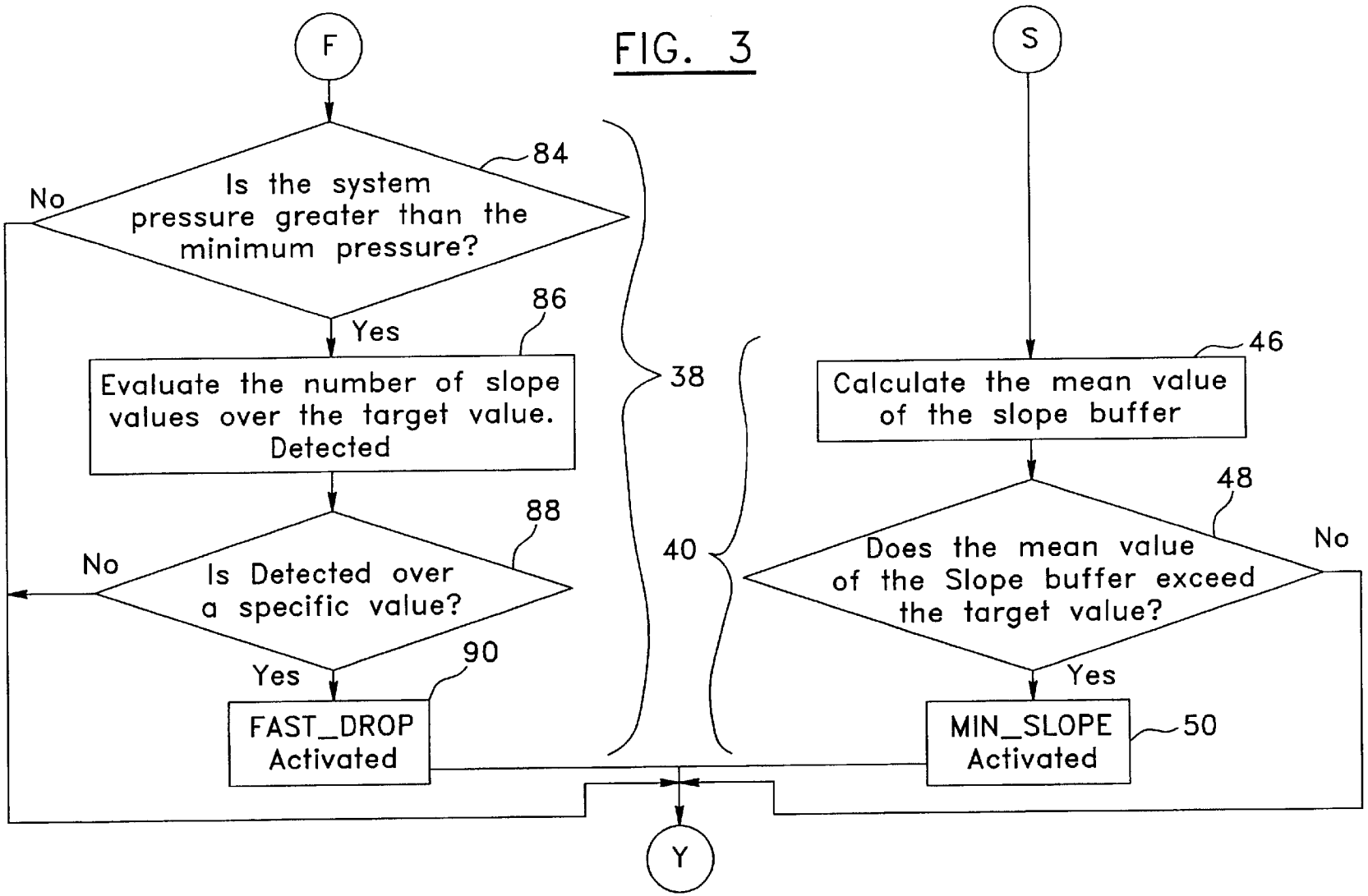

Referring now to FIG. 3, and more specifically to subroutine 40, a mean value of the series of pressure slope values contained in the slope buffer is calculated in the operation step 46 and then this mean value is compared with a target value at the operation step 48. If the mean value exceeds the target value then the MIN SLOPE variable is activated at operation step 50 to produce the second positive signal referred to above. Producing the second positive signal is essential for activating the virtual accelerator according to the first embodiment of the invention.

In order to prevent unwanted activation of the virtual accelerator, the latest slope value and the current pressure value are treated by means of subroutines 42 and 44. In essence, the subroutines 42 and 44 perform a low pass filtering of the signal detected by the analog pressure transducer 9 shown in FIG. 1 to produce the first positive signal. Producing the first positive signal is essential for activating the virtual accelerator according to the first embodiment of the invention.

Referring now to FIG. 4, and more specifically to subroutine 42, the newest pressure slope value in the slope buffer is compared with a reference slope value at operation step 52. If the newest pressure slope value is equal or exceeds the reference slope value, then a content unit is subtracted from a virtual reservoir at operation step 54. Then, if the virtual reservoir is empty as verified in operation step 56, the RES EMPTY variable (empty reservoir signal) is activated at operation step 58. However, if the newest pressure slope is below the reference slope value, and if the virtual reservoir is not full as verified in operation step 60, then a content unit is added to the virtual reservoir at operation step 62.

Referring now to FIGS. 5A and 5B, and more specifically to subroutine 44, the newest pressure in the pressure buffer is compared with a virtual reservoir pressure value in operation step 64. If the newest pressure value is below the virtual reservoir pressure value, then the virtual reservoir pressure value is decreased at operation step 66. However, if the newest pressure value is equal or exceeds the virtual reservoir pressure value, then the newest pressure value in the pressure buffer is compared with the virtual reservoir pressure value in operation step 68. If the newest pressure value exceeds the virtual reservoir pressure value, then the virtual reservoir pressure value is increased at operation step 70. In any case, a pressure difference between the newest pressure value and the virtual reservoir pressure value is stored in a differential buffer at operation step 72. Each pressure difference stored in the differential buffer is compared with a pressure difference target value, and a number of these pressure differences that are over the pressure difference target value is counted at operation step 74. The number of pressure differences that are over the pressure difference target value is compared with a predetermined value in operation step 76. If number of pressure differences that are over the pressure difference target value exceeds the predetermined value, then the PRES DIFF variable (pressure difference signal) is activated at operation step 78.

The treated signal is considered within the low pass range if the RES EMPTY and PRES DIFF variables are activated. Therefore, once the variations of pressure are filtered by the low pass filter embodied in subroutines 42 and 44, the first positive signal is generated if the variations are within the low pass filter range i.e. if the empty reservoir and pressure difference signals are occurring simultaneously during the predetermined period of time. The second positive signal is generated if the MIN SLOPE variable is activated in subroutine 40. The alarm signal is generated when the first and second positive signals are occurring simultaneously during the predetermined period of time.

Referring now to FIG. 6, when the variables MIN SLOPE, RES EMPTY and PRES DIFF are simultaneously activated, as verified in operation step 80, then it means that the first condition 37 shown in FIG. 2B is met. The virtual accelerator is positively activated at operation step 82 and the alarm signal is generated.

We will now describe a preferable embodiment of the invention which is related to the second condition 39 shown in FIG. 2B. The second condition 39 is there because sometimes, the pressure drop within the piping of the sprinkler system 16 is such that the system or base controller 3 knows that this drop has to result in a positive activation of the virtual accelerator and the system or base controller 3 does not want to wait for the confirmation of subroutines 40, 42 and 44. The second condition 39 means that a fast pressure drop has been detected within the piping of the sprinkler system 16. This second condition is determined by subroutine 38.

We will now refer to subroutine 38 of FIG. 3. The system compares the newest pressure value in the slope buffer with a minimum pressure reference value by means of operation step 84. If the result is positive, the system counts the number of slope values that are over a target value. The resulting number is stored in a variable called "detected" in operation step 86. Then, the system compares the value of the "detected" variable with a specific value in operation step 88. If the result is positive, then the FAST DROP variable is activated at operation step 90 and the virtual accelerator is immediately activated.

Figure 7:
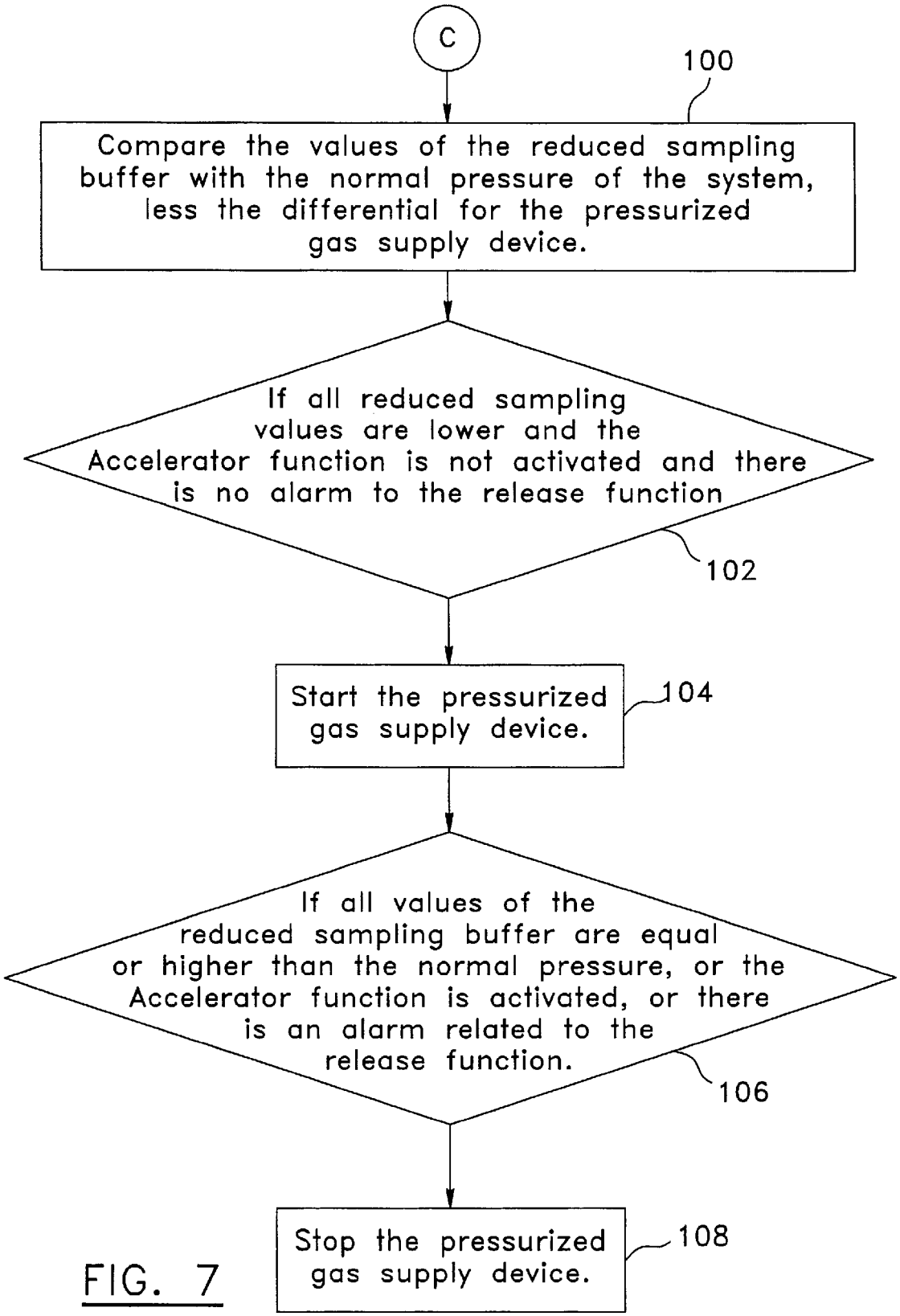
FIG. 7 shows a flow diagram illustrating a method of controlling the pressurized gas supply device.

Referring now to FIGS. 1 and 7, we will describe how the signal generated by the transducer 9 can be used to control the pressurized gas supply device 10. Values of the signal provided by the transducer are sampled in a reduced sampling buffer provided by the base controller 3. The values of a reduced sampling buffer are compared with the normal pressure of the system less the differential for the pressurized gas supply device 10 at operation step 100. If all reduced sampling values are below and an accelerator function is not activated, and there is no alarm related to a release function as verified in operation step 102, then the pressurized gas supply device 10 is started at operation step 104. If all the values of the reduced sampling buffer are equal or higher than the normal pressure, or the accelerator function is activated, or there is an alarm related to the release function as verified in operation step 106, then the pressurized gas supply device 10 is stopped at operation step 108.

Figure 8:
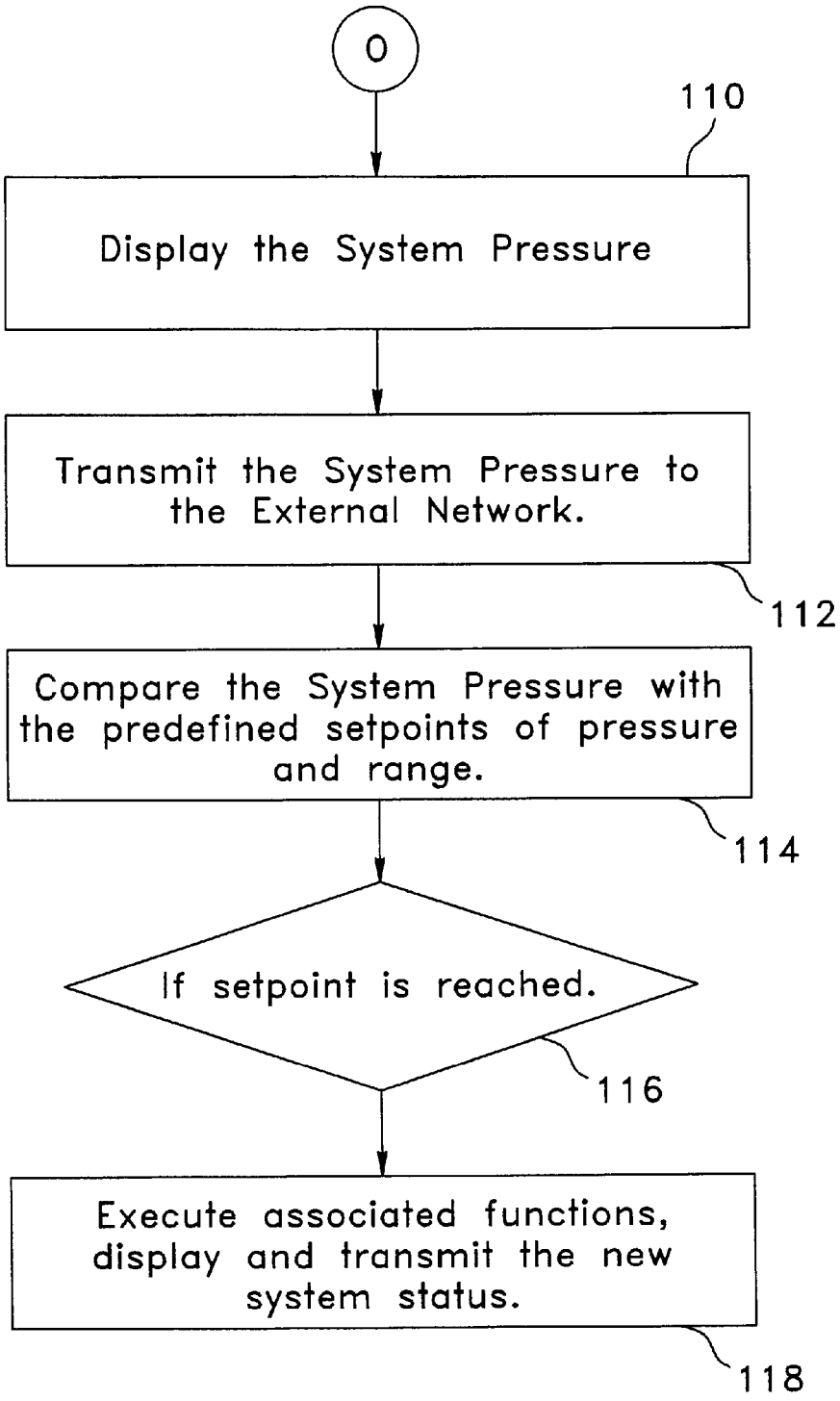
FIG. 8 shows a flow diagram illustrating a method of using the data provided by the pressure transducer shown in FIG. 1.

Referring now to FIGS. 1 and 8, we will describe how the signal provided by the transducer 9 can be used for additional purposes not directly concerned with the virtual accelerator. The display of the system pressure is done on the console 4 at operation step 110. The system pressure is transmitted to the external network 5 at operation step 112. The system pressure is compared with predefined setpoints of pressure and range at operation step 114. If the setpoint is reached as verified in operation step 116, then associate functions are executed, and the new system status is displayed and transmitted at operation step 118.

Although the present invention has been explained hereinabove by way of a preferred embodiment thereof, it should be understood that the invention is not limited to this precise embodiment and that various changes and modifications may be effected therein without departing from the scope or spirit of the invention.

What is claimed is:

1. A virtual accelerator for detecting an alarm condition within a pressurized gas sprinkler system, comprising:

a pressure monitoring means for monitoring pressure within the pressurized gas sprinkler system, and generating a pressure signal representative of the pressure thereof;

sampling means for sampling the pressure signal at a given frequency during a predetermined period of time, and generating a series of pressure values; and detecting means for detecting variations of the pressure values, and generating an alarm signal if the variations are within a predetermined range, the detecting means further comprising a low pass filter for low pass filtering the variations of the pressure values, and generating a first positive signal if the variations are within a low pass filter range.

2. A virtual accelerator according to claim 1, wherein the detecting means further comprise:

first calculating means for calculating pressure change rates of the pressure signal within the predetermined period of time by means of the pressure values;

second calculating means for calculating a mean value of the pressure change rates;

first comparing means for comparing the mean value with a target value, and generating a second positive signal if the mean value exceeds the target value; and alarm signal generating means for generating the alarm signal in response to an occurrence of the first and second positive signals simultaneously during the predetermined period of time.

3. A virtual accelerator according to claim 1, wherein the pressure monitoring means is a pressure transducer.

4. A virtual accelerator according to claim 3, wherein the detecting means and the sampling means are embodied in a base controller provided with a software.

5. A virtual accelerator according to claim 4, wherein the pressure transducer is an analog pressure transducer transmitting a continuous analog pressure signal to the base controller.

6. A virtual accelerator according to claim 4, further comprising a console and a master controller connected to the base controller, for controlling communications with an external network and with the console.

7. A virtual accelerator according to claim 6, wherein the console comprises a display unit, an electronic buzzer and interface key switches to allow communication between an operator and the base controller via the master controller.

8. A method for detecting an alarm condition within a pressurized gas sprinkler system, comprising the steps of:

(a) monitoring pressure within the pressurized gas sprinkler system, and generating a pressure signal representative of the pressure thereof;

(b) sampling the pressure signal at a given frequency during a predetermined period of time, and providing a series of pressure values; and (c) detecting variations of the pressure values, and generating an alarm signal if the variations are within a predetermined range, the step of detecting variations further comprising the step of (i) low pass filtering the variations of the pressure values, and generating a first positive signal if the variations are within a low pass filter range.

9. The method according to claim 8, wherein step (c) further comprises the steps of:

(ii) calculating pressure change rates of the pressure signal within the predetermined period of time by means of the pressure values;

(iii) calculating a mean value of the pressure change rates;

(iv) comparing the mean value with a target value, and generating a second positive signal if the mean value exceeds the target value; and (v) generating the alarm signal when said first and second positive signals are occurring simultaneously during the predetermined period of time.

10. The method according to claim 9, wherein step (b) comprises the steps of:

storing each value of the series of pressure values in a circular pressure buffer according to a chronological order; and when the circular pressure buffer is full, removing an oldest pressure value from the buffer, and storing a newest pressure value in the buffer according to a chronological order.

11. The method according to claim 10, wherein, in step (c) (ii), the pressure change rates are calculated by calculating a series of pressure slope values from subsequent pairs of newest and oldest pressure values stored in the pressure buffer, and storing the series of pressure slope values in a slope buffer according to a chronological order.

12. The method according to claim 11, wherein, in step (c) (iii), the mean value is calculated by calculating a mean value of the series of pressure slope values in the slope buffer.

13. The method according to claim 12, wherein, in step (c) (i), the low pass filtering step comprises the steps of:

(A) comparing a newest pressure slope value in the slope buffer with a reference slope value, and:

if the newest pressure slope value is equal or exceeds the reference slope value then:

subtracting a content unit from a virtual reservoir; and verifying whether the virtual reservoir is empty and if said virtual reservoir is empty then generating an empty reservoir signal;

or else verifying whether the virtual reservoir is not full and if said virtual reservoir is not full then adding a content unit to the virtual reservoir;

(B) comparing the newest pressure value in the pressure buffer with a virtual reservoir pressure value, and:

if the newest pressure value is below the virtual reservoir pressure value then decreasing the virtual reservoir pressure value;

or else comparing the newest pressure value in the pressure buffer with the virtual reservoir pressure value, and if said newest pressure value exceeds the virtual reservoir pressure value then increasing the virtual reservoir pressure value;

storing a pressure difference between the newest pressure value and the virtual reservoir pressure value in a differential buffer;

comparing each pressure difference stored in the differential buffer with a pressure difference target value, and counting a number of these pressure differences that are over said pressure difference target value;

comparing the number of pressure differences that are over the pressure difference target value with a predetermined value, and generating a pressure difference signal if the number exceeds the predetermined value; and (C) verifying whether the empty reservoir and pressure difference signals are occurring simultaneously during the predetermined period of time and if said empty reservoir and pressure difference signals are occurring simultaneously during the predetermined period of time then generating the first positive signal, or else return to step (a).

14. The method according to claim 11, wherein step (c) further comprises the steps of:

comparing the newest pressure value in the pressure buffer with a minimum pressure reference value, and if the newest pressure value exceeds the minimum preference reference value then:

comparing each pressure slope value stored in the slope buffer with a slope target value, and counting a number of these pressure slope values that are over said slope target value; and comparing the number of pressure slope values that are over the slope target value with a specific value, and generating the alarm signal if the number exceeds a specific value, or else return to step (a);

or else return to step (a).

* * * * *